United States Patent [19]

Mars

[11] 4,126,007

[45] Nov. 21, 1978

[54] COMPACTION OF SOIL

[75] Inventor: Bernard S. Mars, Pittsburgh, Pa.

[73] Assignee: L.B. Foster Company, Pittsburgh, Pa.

[21] Appl. No.: 756,327

[22] Filed: Jan. 3, 1977

[51] Int. Cl.[2] ..... E02D 5/34

[52] U.S. Cl. ..... 405/271; 405/240

[58] Field of Search ..... 61/53, 53.5, 53.64, 61/53.66, 11, 35

[56] References Cited

U.S. PATENT DOCUMENTS

| | | | |
|---|---|---|---|
| 779,880 | 1/1905 | Shuman | 61/53.64 |
| 1,979,547 | 11/1934 | Hood | 61/53.64 |
| 2,576,507 | 11/1951 | Gerwick, Jr. | 61/53.64 |
| 3,385,070 | 5/1968 | Jackson | 61/53.66 |
| 3,464,215 | 9/1969 | Spanovich | 61/53.64 |
| 3,543,525 | 12/1970 | Phares | 61/53.66 |
| 3,608,317 | 9/1971 | Landau | 61/53.64 |
| 3,797,251 | 3/1974 | Shimizu | 61/53.64 |
| 3,805,535 | 4/1974 | Van Weele | 61/53.64 |
| 3,973,408 | 8/1976 | Paverman | 61/53.74 |
| 3,975,917 | 8/1976 | Asayama | 61/53 |

FOREIGN PATENT DOCUMENTS

| | | | |
|---|---|---|---|
| 423,752 | 4/1911 | France | 61/53.64 |
| 1,020,373 | 2/1953 | France | 61/53.64 |
| 2,223,998 | 10/1974 | France | 61/53.5 |

*Primary Examiner*—Mervin Stein

*Assistant Examiner*—Alex Grosz

*Attorney, Agent, or Firm*—Kirschstein, Kirschstein, Ottinger & Cobrin

[57] ABSTRACT

An area of soil having an initial low bearing strength, such as an alluvial or sandy area, or an area formed by hydraulic fill, is compacted to provide an improved area of high bearing strength by forming a plurality of granular particulate (e.g., crushed stone, pebbles or sand) columns in pre-compacted holes in the area. The pre-compacted holes are formed by vibratorily driving a hollow probe having openable closure means set in closed position at its lower end, vertically downwardly to form each vertical hole, the soil around the probe thus being compacted. Thereafter, the probe is vibratorily extracted and granular particles are passed downwardly through the probe with the adjustable closure means open. Desirably, the granular material is compacted, i.e., consolidated, thereby further enhancing the bearing strength of the area, either by introducing such material into the probe during vibratory extraction of the probe or by introducing this material before the probe is vibratorily extracted, the probe in either such event inducing vertical vibratory movement of the particles with resultant reduction in the mass volume and lessening of void volume. The area may be further treated by vibratorily tamping with a tamping device having a concentrated high mass.

29 Claims, 10 Drawing Figures

COMPACTION OF SOIL

BACKGROUND OF THE INVENTION

1. Field of the Invention

The invention relates to the upgrading of weak soil areas having low bearing strength, such as alluvial soil or hydraulic fill areas, into compacted soil having high bearing strength.

2. Description of the Prior Art

A prior art soil compaction method has been proposed which uses a vibratory driver to force an open-bottom-ended tube into the ground whereby to compact soil within and outside of the tube, the tube subsequently being vibratorily extracted to enhance compaction. This method has found commercial application as described in an article by Millard et al., "Graving Dock for 300,000 Ton Ships," which appeared in the June 1971 issue of "Civil Engineering - ASCE," and also in an article by Donnelly entitled "River Yields to Below-Sea-Level Dock Construction" which appeared in the March 1971 issue of "Construction Methods and Equipment."

Earlier prior art techniques for soil compaction entailed the usage of sheeps foot rollers or a tamping action employing air hammers or the like. In these techniques, successive layers of the soil were individually successively treated to achieve a measure of compaction. These methods obviously were primarily applicable where a filling of soil was taking place so that successive layers of soil were accessible, i.e., these methods were not generally applicable to in situ alluvial soils or the like or to hydraulic fill.

Other methods of soil compaction in which sand columns or crushed stone columns were formed are described in an article entitled "New Sand Drain Technique Strengthens Weak Soils" which appeared in the April 1971 issue of "Roads and Streets," and in an article entitled "In-Place Treatment of Foundation Soils" which appeared in the January 1970 issue of the "Journal of the Soil Mechanics and Foundations Division, ASCE."

SUMMARY OF THE INVENTION

1. Purposes of the Invention

It is an object of the present invention to provide an improved method and means for the compaction of soil.

Another object is to convert a soil area of low bearing strength such as alluvial soil or hydraulic fill into a soil area of high bearing strength.

A further object is to provide an improved hollow probe for vibratorily compacting soil.

An additional object is to employ inexpensive means and material to increase the bearing strength of soil at low cost.

These and other objects and advantages of the present invention will become evident from the description which follows.

2. Brief Description of the Invention

In the present invention, soil of low bearing strength is compacted to provide a soil area of high bearing strength by a combination of procedural sequences. First, a hollow probe having its lower end closed by openable closure means is vibratorily driven substantially vertically downwardly into the soil. This step forms a vertical hole in the ground and concurrently compacts the soil around the probe, by forcing soil laterally away from the probe as the probe sinks downwardly to form the hole. A plurality of vertically spaced horizontal bands may be provided on the external surface of the hollow probe to increase the compaction of the soil around the probe. The next step in the method entails vibratorily extracting the probe upwardly from the hole with the closure means in the open position, while concomitantly passing solid particulate material, consisting principally of crushed stone particles having a size in the range of about 1 inch to about 6 inches, downwardly through the hollow probe. The stone may be added to the probe to fill it prior to starting withdrawal, or it may be added continuously during withdrawal. In either event, the stone is consolidated as the probe is vibratorily withdrawn from within the opening in the soil formed by the withdrawn probe. Thus, a compacted stone column is formed in the hole as the probe is removed, with said column and the adjacent compacted soil serving to provide an area of soil of high bearing strength. The procedure is repeated at a plurality of locations in the area to be treated, generally in a regular pattern of holes filled with crushed stone columns, so that the entire area is upgraded into a firm soil area of high bearing strength.

The method is generally applicable to any soil area which is to be improved with regard to bearing strength. However, the method is especially applicable to alluvial soil, sandy soils, hydraulic fill areas, and even to underwater soil areas which have to be stabilized, e.g., prior to the installation of an oil drilling platform in a lake or coastal sea area or even in the open ocean.

In a preferred embodiment, after a plurality of stone columns has been installed in the soil area to be improved, a tamper having a high concentrated mass, e.g., 6 tons, is vibratorily applied over the entire area, typically by vertically vibrating the tamper at about 700 to about 2,000 cycles per second at an amplitude in the range of about 0.5 to about 3 millimeters. This procedure serves to further uniformly consolidate the soil, especially the upper layer of typically the first six feet of soil below the surface, and also provides further compaction of soil at greater depths by more firmly emplacing the stone columns in situ.

The crushed stone to be employed in formation of the stone columns may be any suitable stone or stone-like material available on the job site, e.g., sedimentary rocks such as limestone, sandstone or shale or other readily accessible stone. Even pebbles, gravel, or quartz or the like may be employed. The softer types of igneous rock also may be employed in the invention. In other words, any readily accessible stone or stone-like material of initially small particulate size range or readily crushable may be employed. Desirably, the stone is of a suitable size distribution range for optimum filling of the hole. This size distribution range as mentioned supra is typically in the range of about 1 inch to about 6 inches, although particulate material of smaller sizes may be employed, e.g., sand or the like may be entrained with the stone filling, especially if pebbles or gravel are used as the stone filling.

The hollow probe of the invention is of a novel configuration. The linear probe is preferably cylindrical, with a substantially uniform cross-section which typically is circular; however, it may be square, hexagonal or of other polygonal configuration cross-section, although probes of non-circular cross-section are more expensive. The probe may, of course, be of slightly downwardly tapered configuration, a typical taper being $\frac{1}{2}°$ to 5° from the vertical. The length of the probe preferably is such that its lower end will reach a bearing substrated; 100 feet is not unusual.

An openable closure means such as a clamshell valve is provided at the lower end of the probe. Vertical vibratory driving means is detachably secured to the upper end of the probe, a typical such vertical vibratory driving means being described in U.S. Pat. No. 3,621,659. It will be understood that any suitable vertical vibratory or vibro-percussive driving means may be employed, for example those described in U.S. Pat. Nos. 3,564,932; 3,433,311; 3,394,766; 3,391,435 and 3,368,632. The hollow probe is further characterized in a preferred embodiment by the provision of a plurality of vertically spaced horizontal bands on the external surface of the probe, to further promote compaction of the soil around the probe.

Another preferred feature of the probe device is the provision of a plurality of liquid jet means in combination with the openable closure means at the lower end of the probe. The liquid jet means are oriented to pass jets of liquid downwardly below the openable closure means as the probe vibratorily moves downwardly to form the hole. The liquid, such as water, which is jetted out below the probe, serves to facilitate the downward passage of the probe. In instances where the ground is water-laden to begin with, the liquid jets aspect of the invention may not be required or necessary but, in any case, the liquid jets feature is a preferred ancillary feature of the invention.

There are several salient advantages of the present invention. A high degree of soil consolidation and compaction is attained, and the resulting compacted soil area may have as high a bearing strength as is deemed necessary; e.g., by spacing the stone columns closer together or by making larger diameter holes, a greater overall load bearing strength improvement is attained for the treated soil area. The procedure entails the usage of inexpensive means to form the hole, together with inexpensive means to fill the hole, i.e., crushed stone. A greater degree of improvement in soil bearing strength is attained than with prior art methods such as that of U.S. Pat. No. 3,621,659 mentioned above. The invention generally is applicable to any soil area or area of the ground deemed desirable for improvement, either on land, areas marginal to water bodies, or even areas under water. Finally, the improvement in the soil area is permanent in nature since the stone columns, once emplaced, are there to stay forever. Ground water seepage or the like cannot impair the strength of the stone columns, and the stone columns cannot rot or otherwise weaken with time as is the case with wooden pilings.

The invention consists in the features of construction, combination of elements, arrangement of parts and series of steps which will be exemplified in the device and method hereinafter described and of which the scope of application will be indicated in the appended claims.

BRIEF DESCRIPTION OF THE DRAWINGS

Referring now to the drawings.

DETAILED DESCRIPTION OF THE PREFERRED EMBODIMENTS

Figure 1:
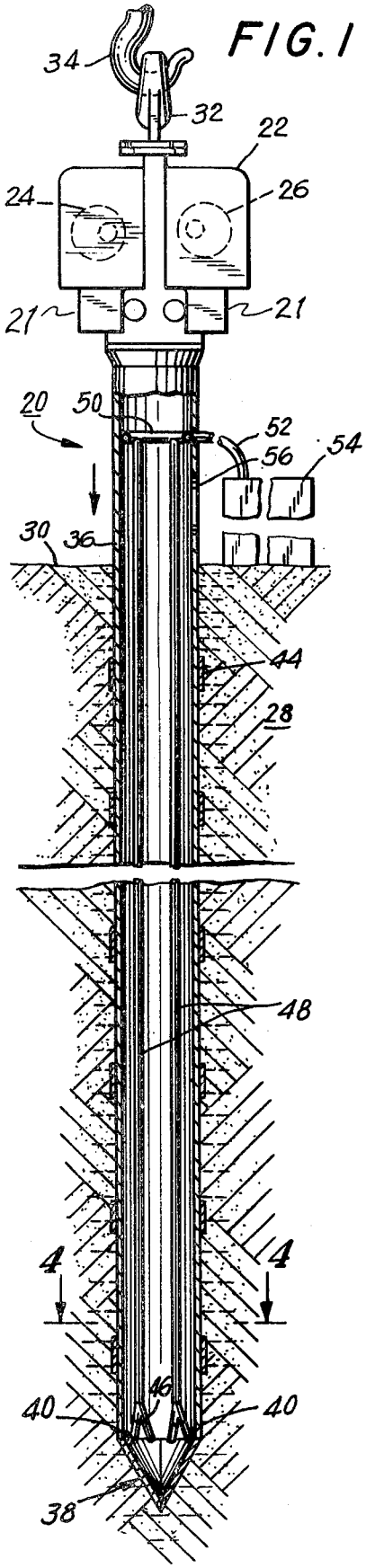
FIG. 1 is a vertical sectional view of the closed-end hollow probe during downward vibrodriving into the ground or soil.

Referring now to FIG. 1, the apparatus of the present invention includes a vertically oriented hollow probe 20 to the upper end of which there is removably secured by a clamp 21 a vibrodriver 22 for applying a vertical vibratory or vibro-percussive force to the probe. The vibrodriver 22 generally is characterized by a plurality of balanced counter-rotating eccentrics such as 24 and 26 which are mounted in the vibrodriver and are rotated about parallel horizontal axes to produce the vibratory force to sink the hollow probe 20 downwardly into the ground or soil 28 and thereby form a vertical hole extending downwardly from the ground surface 30. The vibrodriver is hung by a vertical collar 32 through which a hook 34 extends. The hook 34 is mounted on a pulley (not shown) which extends to a crane. Details of typical vibrodrivers are described in the U.S. patents mentioned above.

The probe 20 in this embodiment of the invention comprises a vertically oriented hollow cylindrical tube 36 having a lower end which is closed by clamshell valve 38, the opposing halves of the upper ends of which are rotatable about parallel horizontal axes on hinges 40 that are located at opposite ends of a diameter of the lower end of the probe so that when, in idle condition, the halves are acted upon by gravitational force only, they will swing inwardly toward each other away from a fully open position (shown in FIG. 2) wherein they constitute extensions of the lower end of the probe. In this idle position the undersurfaces of the two halves slope downwardly and inwardly toward the vertical center line of the probe.

In FIG. 1 the probe 20 is moving downwardly to form the hole in the ground. Hence, the valve 38 is closed, so that the probe 20 has an essentially inverted conical lower end driving point formed by the sections of valve 38. The valve 38 closes upon initial contact with the ground, the halves being cammed to closed position when their inclined undersurfaces enter the ground surface 30. Downward movement of the probe 20 in the vibratory or vibro-percussive mode serves not only to form a vertical hole in the ground 28 but also to compact the surrounding soil as at 42. This soil compaction is further enhanced by the provision of a plurality of vertically spaced horizontal bands 44 on the outer surface of the tube 36. In addition to compacting the surrounding soil by forcing the soil outwardly, the probe induces vibrations in the surrounding soil to enhance soil consolidation.

In the preferred embodiment of FIG. 1, downward passage of the probe 20 is facilitated by the provision of at least one liquid jet nozzle 46 which injects a liquid, usually water, into the soil during downward movement of said probe and thereby facilitates the downward passage of the probe and resultant hole formation. Water or the like is supplied to the lower nozzles 46 through a plurality of vertically oriented pipes 48 which extend downwardly inside the tube 36 to nozzles 46 within the valve 38 from an upper manifold 50, which in turn receives water from a supply pipe 52 extending to the manifold 50 from a water tank 54.

An opening 56 is provided adjacent to the upper end of the tube 36 for subsequent entry of rock particles, as will appear below.

Figure 2:
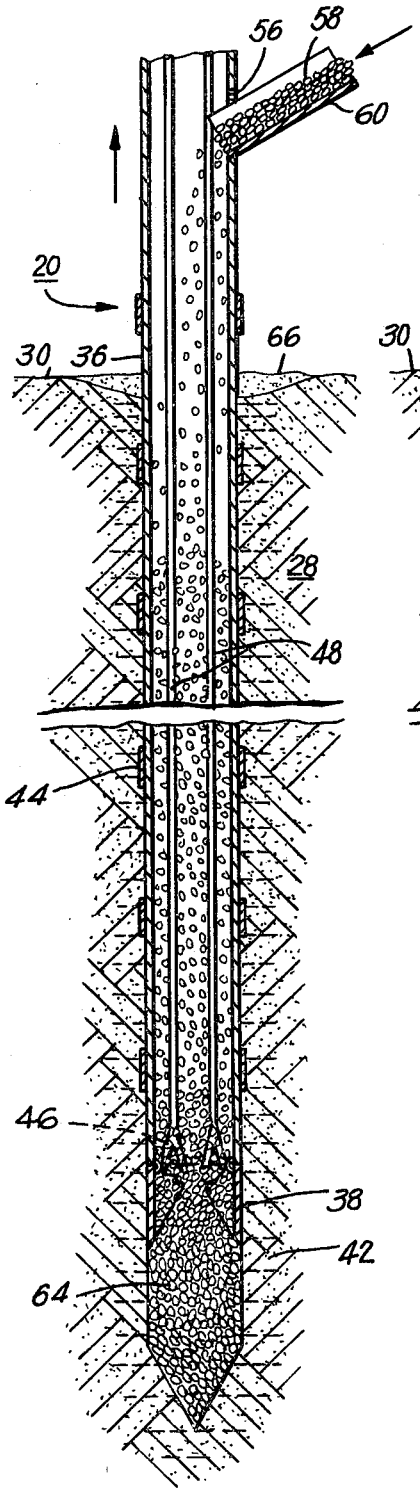
FIG. 2 shows the hollow probe being vibratorily extracted upwardly from the hole in the ground, with the lower end open and while concomitantly passing crushed stone downwardly through the probe, so that the hole becomes filled with crushed stone and a stone column is formed in the ground.

Referring now to FIG. 2, the mode of formation of a rock column is shown after the probe has been sunk to a desired depth, e.g., to a firm substrate. In this figure, the hollow probe is shown as it is being vibratorily extracted upwardly for removal from the hole formed in FIG. 1, with the lower clamshell valve 38 now being in open position, and while concomitantly passing a stream 58 of solid particulate material consisting essentially of stone particles via a feeder trough 60 through the opening 56 and into the tube 36, so that the stone particles fall downwardly inside the tube under the influence of gravity and deposit in and fill the hole 62 to form a stone column 64. The valve 38 is opened by the weight of the rocks in the probe pressing upon the upper surfaces of the valve halves as the probe starts to be withdrawn from the formed hole; it is held open by the continued presence of rocks flowing through the valve as the probe continues to be withdrawn.

FIG. 2 also illustrates the settling of soil at 66 adjacent the hole 62 at the ground surface. It will be evident that the upper layer of typically the first 6 feet of soil below the surface has only been compacted to a limited degree; however, in many instances, this amount of compaction is ample, per se, since the bearing strength of the ground at a lower level has been vastly improved and, depending on the type of load to be borne by the soil, the distribution of the load, the spacings between adjacent stone colums, and various other factors, after the tube 36 is completely removed from the hole 62, with the hole 62 being entirely filled with stone particles typically having a size in the range of about 1 inch to about 6 inches, so that the entire stone column is in place, a finished compacted soil area is produced. A typical range of diameters for the stone columns is 2 to 3 feet.

Figure 3:
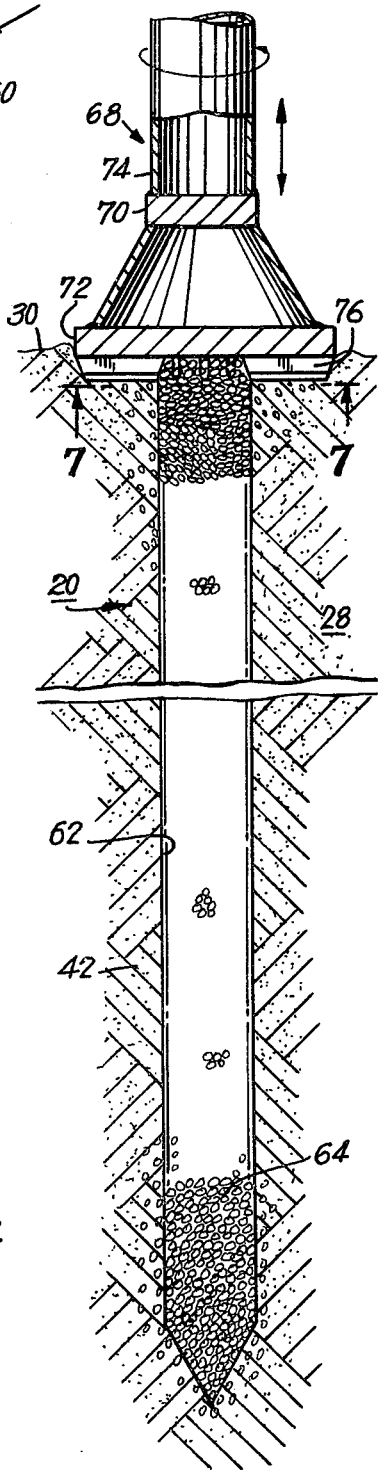
FIG. 3 shows a tamper coaxially in place over the stone column.

Nevertheless, if further compaction of the upper level of the soil around the hole is desired, FIG. 3 illustrates a preferred apparatus and step for accomplishing the same. A tamper 68 having a concentrated high mass is coaxially positioned over the previously formed stone column 64. In practice, the tamper 68 will, of course, also be additionally positioned around the stone column, non-coaxially over the stone column, etc., in random or regular fashion. The tamper 68 is typically characterized by disc-shaped horizontal members 70 and 72 of high mass, e.g., a total of about 6 tons, and generally composed of steel, cast iron, lead or the like. The tamper is of generally frusto-conical configuration with an upper support member 74 extending to means (not shown) for vibrating the tamper 68, typically at about 700 to about 2,000 cycles per second at an amplitude in the range of about 0.5 to about 3 millimeters, so that the first 6 feet or so below the ground surface level 30 is further consolidated and compacted, and also so that the stone column 64 is more firmly emplaced in situ. Thus, subsequent settling of the soil area is effectively curtailed. The tamper 68 is preferably provided with lower depending horizontal linear radial ridges 76 which enhance the tamping action.

Figure 4:
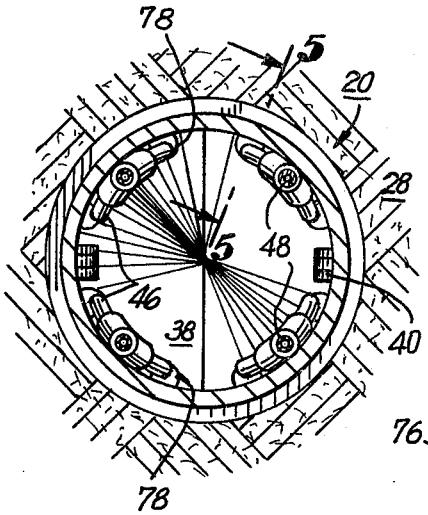
FIG. 4 is an enlarged horizontal sectional view taken substantially along the line 4—4 of FIG. 1 and showing the lower internals of the probe.
Figure 5:
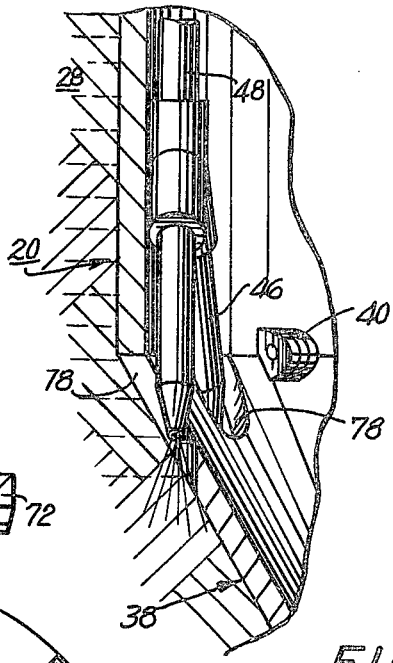
FIG. 5 is an enlarged fragmentary sectional elevational view of the lower end of the probe, taken substantially along the line 5—5 of FIG. 4.

FIGS. 4 and 5 illustrate details of the lower end of the tube 36 of the probe 20. The lower appertenances include nozzles 46 which extend downwardly toward openings 78 in the clamshell valve 38, so that water jets may be sprayed into the soil below the tube as the probe sinks downwardly.

Figure 6:
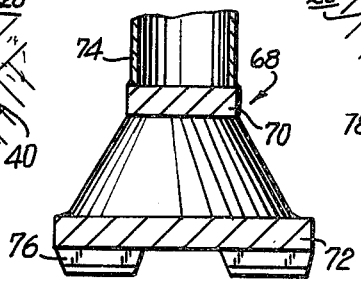
FIG. 6 is a sectional elevational view of the tamper.
Figure 7:
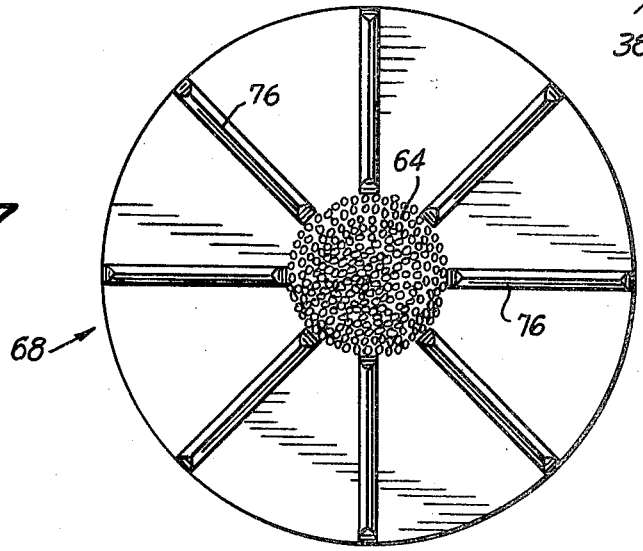
FIG. 7 is an enlarged plan view of the bottom of the tamper while in place over the stone column and taken substantially along the line 7—7 of FIG. 3.

FIGS. 6 and 7 show the tamper, per se, with the bottom ridges 76 formed with lower ends of angular configuartion, i.e., beveled, to further facilitate the tampering action and penetration into the upper soil layer, so that enhanced soil consolidation is attained.

Figure 8:
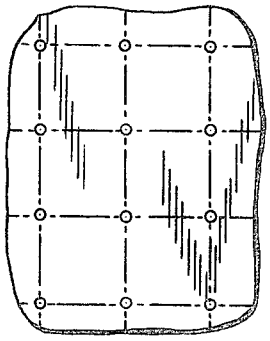
FIG. 8 is a plan view of a typical orderly arrangement of a plurality of stone columns in the ground.

FIG. 8 is a plan view of a compacted area of soil in which the plurality of stone columns is arranged in a regular square pattern, i.e., at the corners of squares of equal dimension. Any suitable regular geometric pattern may be adopted in practice, depending on soil conditions. In some instances, a high concentration of stone columns will be provided in a limited section of the entire soil area to be compacted, typically because the soil may be especially weak due to an underground spring, etc., or because the soil is to bear a particularly heavy load in the limited section.

Figure 9:
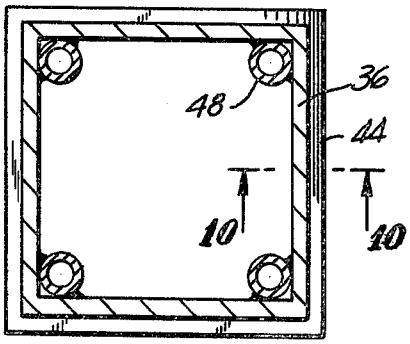
FIG. 9 is a sectional plan view of an alternative configuration of the probe.
Figure 10:
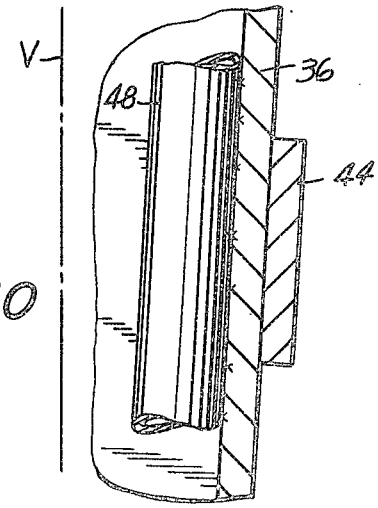
FIG. 10 is an enlarged sectional elevational view of a portion of the probe of FIG. 9 taken substantially along the line 10—10 of FIG. 9 and showing to an exaggerated scale a taper of the probe body from the vertical axis.

FIGS. 9 and 10 show an alternative configuration of a probe, namely, one with a square horizontal cross-section and also a taper, which is shown to an exaggerated scale in FIG. 10 where the probe tapers inwardly in a downward direction relative to a central vertical axis V.

It thus will be seen that there are provided a method of compacting soil and a probe for soil compaction which achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention there is claimed as new and desired to be secured by Letters Patent:

1. A method of compacting soil which comprises (a) vibratorily sinking a hollow probe substantially vertically downwardly into the soil to be compacted, the lower end of said hollow probe having openable closure means which is closed during sinking of said probe to form a vertical hole in said soil by displacing said soil and to compact the soil around said probe by laterally forcing said soil away from the probe, (b) vibratorily extracting said hollow probe upwardly from said hole with said closure means open, and (c) prior to complete extraction of the probe from the hole and at least continuously during withdrawal, passing solid particulate material downwardly through the probe, said closure means being open during extraction, whereby a stone column is provided in said hole and is continuously consolidated by vibratory withdrawal of the probe, said compacted stone column and the adjacent soil compacted according to step (a) serving to provide an area of soil of high bearing strength.

2. The method of claim 1 in which the particulate material is passed downwardly through the probe prior to vibratory extraction of the probe from the hole.

3. The method of claim 1 in which the particulate material is passed downwardly through the probe during vibratory extraction of the probe from the hole.

4. The method of claim 1 wherein the openable closure means is open to the full diameter of the probe during vibratory extraction of the probe from the hole.

5. The method of claim 1 wherein the particulate material includes stone particles having a size in the range of from about 1 to about 6 inches.

6. The method of claim 5 wherein the particulate material further includes sand.

7. The method of claim 1 wherein the particulate material includes gravel.

8. The method of claim 1 wherein the particulate material includes pebbles.

9. The method of claim 1 wherein the particulate material includes crushed stone.

10. The method of claim 1 in which a plurality of discrete stone columns is formed spaced apart over an entire area to be compacted.

11. The method of claim 10 wherein the stone columns are spaced apart in a regular pattern over said area.

12. The method of claim 11 in which the regular pattern is orthogonal.

13. The method of claim 11 in which the regular pattern is a series of squares.

14. The method of claim 1 in which the compacted stone column subsequently is vibratorily tamped with means having a concentrated high mass.

15. The method of claim 14 in which the tamping is carried out additionally on the surface of the ground around the top of the stone column.

16. The method of claim 15 in which the tamping is effected by vibrating the concentrated high mass at about 700 to about 2,000 cycles per second for an amplitude in the range of about 0.5 to about 3 millimeters.

17. The method of claim 1 in which liquid jets are directed from within the hollow probe during sinking toward the bottom of the probe.

18. The method of claim 1 in which the probe includes vertically spaced horizontal bands on its external surface to enhance compaction of the surrounding soil.

19. A probe for soil compaction comprising an elongated vertical linear hollow probe, means detachably secured to the upper end of the probe to vibratorily sink said probe into the ground while laterally forcing said soil away from the probe to compact said soil and subsequently to vibratorily extract the same from the ground, means to pass solid particulate material downwardly through said probe prior to complete extraction of the probe from the ground and at least continuously during extractin, leaving a hole around which the soil is compacted, said hole being filled with said solid particulate material, said solid particulate material being continuously compacted as the probe is withdrawn, and openable closure means at the lower end of the probe which is closed as the probe is sunk and open as the probe is extracted, so that during extraction of the probe the solid particulate material flows from the probe into the hole and is compacted into the hole formed by the previously compacted soil.

20. The probe of claim 19 in which the openable closure means is downwardly tapered.

21. The probe of claim 19 in which the openable closure means constitutes a clamshell valve.

22. The probe of claim 21 in which the clamshell valve constitutes two opposed halves.

23. The probe of claim 22 in which means is included to hinge the upper edges of the opposed halves of the clamshell valve at the opposite ends of a diameter at the lower end of the probe.

24. The probe of claim 23 in which the weight of the halves of the clamshell valve is so distributed and rotatable about horizontal axes on hinge means that when the probe is vertical and above the ground in idle condition the halves being acted upon by gavitational force only will swing inwardly toward each other away from a fully open position and toward each other away from a fully open position and toward a closed position.

25. The probe of claim 24 wherein the undersurfaces of the halves of the clamshell valve, when above the ground, are inclined downwardly and inwardly so that when the probe is lowered into contact with the ground the halves are cammed to closed position.

26. The probe of claim 25 wherein the inner surfaces of the halves of the clamshell valve, when the probe is being extracted, swing apart to define an opening of substantially the same size as the interior cross-section of the probe.

27. The probe of claim 19 in which a plurality of liquid jet means is provided to direct jets of liquid downwardly within the probe toward the openable closure means.

28. The probe of claim 27 wherein the openable closure means has apertures therein to pass liquid issuing from the jets into the ground.

29. The probe of claim 19 wherein vertically spaced bands are provided on the external surface of the probe.

* * * * *